US008229134B2

(12) United States Patent
Duraiswami et al.

(10) Patent No.: US 8,229,134 B2
(45) Date of Patent: Jul. 24, 2012

(54) AUDIO CAMERA USING MICROPHONE ARRAYS FOR REAL TIME CAPTURE OF AUDIO IMAGES AND METHOD FOR JOINTLY PROCESSING THE AUDIO IMAGES WITH VIDEO IMAGES

(75) Inventors: Ramani Duraiswami, Highland, MD (US); Adam O'Donovan, Bethesda, MD (US); Nail A. Gumerov, Elkridge, MD (US)

(73) Assignee: University of Maryland, College Park, MD (US)

( * ) Notice: Subject to any disclaimer, the term of this patent is extended or adjusted under 35 U.S.C. 154(b) by 1033 days.

(21) Appl. No.: 12/127,451

(22) Filed: May 27, 2008

(65) Prior Publication Data

US 2009/0028347 A1 Jan. 29, 2009

Related U.S. Application Data

(60) Provisional application No. 60/939,891, filed on May 24, 2007.

(51) Int. Cl.
*H04R 3/00* (2006.01)

(52) U.S. Cl. ..... 381/92; 381/111; 348/462; 348/515; 367/7

(58) Field of Classification Search ..... 381/92, 381/111; 367/7; 348/462, 515
See application file for complete search history.

(56) References Cited

U.S. PATENT DOCUMENTS

2003/0147539 A1* 8/2003 Elko et al. ..... 381/92
2003/0160862 A1* 8/2003 Charlier et al. ..... 348/14.08

OTHER PUBLICATIONS

O'Donovan et al., "Real Time Capture of Audio Images and Their Use With Video", IEEE Workshop, Percep. Inter. and Reality Lab, Comp Sci & UMIACS, Univ. of MD (Oct. 2007).

O'Donovan et al., "Spher. Micro. Array Based Immersive Audio Scene Rend", Proc. of 14th Int. Conf, FR,Per. Inter Co and Reality Lab, Comp Sci & UMIACS, Univ. of MD (Jun. 2008).

Ma et al., "Motion Recovery From Image Sequences: Discrete Viewpoint vs. Differential Viewpoint", Proc of ECCV (1998).

Li et al., "Flexible and Optimal Design of Spherical Microphone Arrays for Beamforming," IEEE Transactions on Speech and Audio Processing (Nov. 2005).

Li et al., "Hemispherical Microphone Arrays for Sound Capture and Beamforming", IEEE Workshop on App. of Signal Processing to Audio and Acoustics, pp. 106-109 (Oct. 2005).

(Continued)

*Primary Examiner* — Steven J Fulk
(74) *Attorney, Agent, or Firm* — Foley & Lardner LLP

(57) ABSTRACT

Spherical microphone arrays provide an ability to compute the acoustical intensity corresponding to different spatial directions in a given frame of audio data. These intensities may be exhibited as an image and these images are generated at a high frame rate to achieve a video image if the data capture and intensity computations can be performed sufficiently quickly, thereby creating a frame-rate audio camera. A description is provided herein regarding how such a camera is built and the processing done sufficiently quickly using graphics processors. The joint processing of and captured frame-rate audio and video images enables applications such as visual identification of noise sources, beamforming and noise-suppression in video conferencing and others, by accounting for the spatial differences in the location of the audio and the video cameras. Based on the recognition that the spherical array can be viewed as a central projection camera, such joint analysis can be performed.

34 Claims, 5 Drawing Sheets

OTHER PUBLICATIONS

Li et al., "Flexible Layout and Optimal Cancellation of the Orthonormality Error for Spherical Microphone Arrays", Proc. IEEE Int. Conf. on Acoustics, Speech and Signal Proc., (ICASSP -04), 4:41-44(2004).
Kidron et al., "Pixels that Sound", Proc. IEEE Computer Vision & Pattern Recognition (CVPR 2005).
Grossberg et al., "A General Imaging Model and a Method for Finding its Parameters", Proc. Intl. Conf. on Computer Vision, pp. 108-115 (2001).
Duraiswami et al., "High Order Spatial Audio Capture and its Binaural Head-Tracked Playback over Headphones with HRTF Cues", Audio Eng. Soc. Conv. Paper, NY, NY (Oct. 2005).
Chan et al., "A Simple and Efficient Estimator for Hyperbolic Location", IEEE Transactions on Signal Proc., vol. 42, No. 8, pp. 1905-1915 (Aug. 1994).
Brandstein et al., "A Robust Method for Speech Signal Time-Delay Estimation in Reverberant Rooms", Proc. ICASSP-96, Atlanta, GA (May 7-10).
Beal et al., "A Graphical Model for Audiovisual Object Tracking", IEEE Transactions on Pattern Analysis and Machine Intelligence, vol. 25, No. 7 (Jul. 2003).
Barreto et al., "Wide Area Multiple Camera Calibration and Estimation of Radial Distortion". OMNIVIS—Workshop on Omnidirectional Vision and camera Networks, Prague, Czech Rep. (2004).
Zotkin et al., "Accelerated Speech Source Localization via a Hierarchical Search of Steered Response Power", IEEE Trans on Speech and Audio Proc., vol. 12, No. 5, pp. 499-508 (Sep. 2004).
Zotkin et al., "Joint Audio-Visual Tracking using Particle Filters", EURASIP Journal on App. Signal Proc., 11:1154-1164 (Nov. 2002).
Vermaak et al., "Nonlinear Filtering for Speaker Tracking in Noisy and Reverberant Environments", IEEE ICASSP, Salt Lake City, UT, vol. 5, pp. 3021-3024 (2001).
De La Torre et al., "Learning to Track Multiple People in Omnidirectional Video", ICRA (Apr. 2005).
Ramalingam et al., "Towards Complete Generic Camera Calibration", CVPR IEEE Conf on Comp Vision and Pattern Recognition, vol. 1, pp. 1093-1098 (2005).
Rafaely, "Plane Wave Decomposition of the Sound Field on a Sphere by Spherical Convolution", Univ. of Southampton, ISVR Tech. Memo 910 (May 2003).
Bub et al., "Knowing who to listen to in speech recognition: visually guidedbeamforming", Acoustics, Speech and Signal Proc., ICASSP-95, vol. 1, pp. 848-851 (1995).
Lienhart et al., "A Detector Tree of Boosted Classifiers for Real-Time Object Detection and Tracking", IEEE ICME2003, vol. 2, pp. 277-280 (2003).

* cited by examiner

AUDIO CAMERA USING MICROPHONE ARRAYS FOR REAL TIME CAPTURE OF AUDIO IMAGES AND METHOD FOR JOINTLY PROCESSING THE AUDIO IMAGES WITH VIDEO IMAGES

PRIORITY

The present application claims priority to a U.S. provisional patent application filed on May 24, 2007 and assigned U.S. Provisional Patent Application Ser. No. 60/939,891, the entire contents of which and the references cited therein are incorporated herein by reference. The following published references relate to the present application. The entire contents of these references are incorporated herein by reference: Adam O'Donovan, Raniani Duraiswami, and Jan Neumann, Microphone Arrays as Generalized Cameras for Integrated Audio Visual Processing, Jun. 21, 2007, Proceedings IEEE CVPR; Adam O'Donovan, Ramani Duraiswami, Nail A. Gumerov, Real Time Capture of Audio Images and Their Use with Video, Oct. 22, 2007, Proceedings IEEE WASPAA; Adam O'Donovan, Ramani Duraiswami, Dmitry N. Zotkin, Imaging Concert Hall Acoustics Using Visual and Audio Cameras, April 2008, Proceedings IEEE ICASSP 2008; and Adam O'Donovan, Dmitry N. Zotkin, Ramani Duraiswami, Spherical Microphone Array Based Immersive Audio Scene Rendering, Jun. 24-27, 2008, Proceedings of the 14$^{th}$ International Conference on Auditory Display.

BACKGROUND

Over the past few years there have been several publications that deal with the use of spherical microphone arrays. Such arrays are seen by some researchers as a means to capture a representation of the sound field in the vicinity of the array, and by others as a means to digitally beamform sound from different directions using the array with a relatively high order beampattern, or for nearby sources. Variations to the usual solid spherical arrays have been suggested, including hemispherical arrays, open arrays, concentric arrays and others.

A particularly exciting use of these arrays is to steer it to various directions and create an intensity map of the acoustic power in various frequency bands via beamforming. The resulting image, since it is linked with direction can be used to identify source location (direction), be related with physical objects in the world and identify sources of sound, and be used in several applications. This brings up the exciting possibility of creating a "sound camera."

To be useful, two difficulties must be overcome. The first, is that the beamforming requires the weighted sum of the Fourier coefficients of all the microphone signals, and multi-channel sound capture, and it has been difficult to achieve frame-rate performance, as would be desirable in applications such as videoconferencing, noise detection, etc. Second, while qualitative identification of sound sources with real-world objects (speaking humans, noisy machines, gunshots) can be done via a human observer who has knowledge of the environment geometry, for precision and automation the sound images must be captured in conjunction with video, and the two must be automatically analyzed to determine correspondence and identification of the sound sources. For this a formulation for the geometrically correct warping of the two images, taken from an array and cameras at different locations is necessary.

SUMMARY

Due to the recognition that spherical array derived sound images satisfy central projection, a property crucial to geometric analysis of multi-camera systems, it is possible to calibrate a spherical-camera array system, and perform vision-guided beamforming. Therefore, in accordance with the present disclosure, the spherical-camera array system, which can be calibrated as it has been shown, is extented to achieve frame-rate sound image creation, beamforming, and the processing of the sound image stream along with a simultaneously acquired video-camera image stream, to achieve "image-transfer," i.e., the ability to warp one image on to the other to determine correspondence. One of the ways this is achieved is by using graphics processors (GPUs) to do the processing at frame rate.

In particular, in accordance with the present disclosure there is provided an audio camera having a plurality of microphones for generating audio data. The audio camera further has a processing unit configured for computing acoustical intensities corresponding to different spatial directions of the audio data, and for generating audio images corresponding to the acoustical intensities at a given frame rate. The processing unit includes at least one graphics processor; at least one multi-channel preamplifier for receiving, amplifying and filtering the audio data to generate at least one audio stream; and at least one data acquisition card for sampling each of the at least one audio stream and outputting data to the at least one graphics processor. The processing unit is configured for performing joint processing of the audio images and video images acquired by a video camera by relating points in the audio camera's coordinate system directly to pixels in the video camera's coordinate system. Additionally, the processing unit is further configured for accounting for spatial differences in the location of the audio camera and the video camera. The joint processing is performed at frame rate.

In accordance with the present disclosure there is also provided a method for jointly acquiring and processing audio and video data. The method includes acquiring audio data using an audio camera having a plurality of microphones; acquiring video data using a video camera, the video data including at least one video image; computing acoustical intensities corresponding to different spatial directions of the audio data; generating at least one audio image corresponding to the acoustical intensities at a given frame rate; and transferring at least a portion of the at least one audio image to the at least one video image. The method further includes relating points in the audio camera's coordinate system directly to pixels in the video camera's coordinate system; and accounting for spatial differences in the location of the audio camera and the video camera. The transferring step occurs at frame rate.

In accordance with the present disclosure, there is also provided a computing device for jointly acquiring and processing audio and video data. The computing device includes a processing unit. The processing unit includes means for receiving audio data acquired by a microphone array having a plurality of microphones; means for receiving video data acquired by a video camera, the video data including at least one video image; means for computing acoustical intensities corresponding to different spatial directions of the audio data; means for generating at least one audio image corresponding to the acoustical intensities at a given frame rate; and means for transferring at least a portion of the at least one audio image to the at least one video image at frame rate.

The computing device further includes a display for displaying an image which includes the portion of the at least one audio image and at least a portion of the video image. The computing device further includes means for identifying the location of an audio source corresponding to the audio data, and means for indicating the location of the audio source. The computing device is selected from the group consisting of a handheld device and a personal computer.

DETAILED DESCRIPTION

I. Real Time Capture of Audio Images and Their Use With Video

A. Beamforming

Beamforming with Spherical Microphone Arrays: Let sound be captured at N microphones at locations $\Theta_s=(\theta_s,\phi_s)$ on the surface of a solid spherical array. Two approaches to the beamforming weights are possible. The modal approach relies on orthogonality of the spherical harmonics and quadrature on the sphere, and decomposes the frequency dependence. It however requires knowledge of quadrature weights, and theoretically for a quadrature order P (whose square is related to the number of microphones S) can only achieve beampatterns of order P/2. The other requires the solution of interpolation problems of size S (potentially at each frequency), and building of a table of weights. In each case, to beamform the signal in direction $\Theta=(\theta,\phi)$ at frequency f (corresponding to wavenumber $k=2\pi f/c$, where c is the sound speed), we sum up the Fourier transform of the pressure at the different microphones, $d_s^k$ as $$\psi(\Theta;k)=\sum_{s=1}^{S} w_N(\Theta,\Theta_s,ka)d_s^k(\Theta_s). \tag{1}$$

In the modal case (J. Meyer & G. Elko, 2002, A Highly Scalable Spherical Microphone Array Based on an Orthonormail Decomposition of the Soundfield, IEEE ICASSP 2002, vol. 2, pp. 1781-1784, the entire contents of which are herein incorporated by reference), the weights $w_N$ are related to the quadrature weights $C_n^m$ for the locations $\{\Theta_s\}$, and the $b_n$ coefficients obtained from the scattering solution of a plane wave off a solid sphere $$w_N(\Theta,\Theta_s,ka)=\sum_{n=0}^{N}\frac{1}{2i^n b_n(ka)}\sum_{m=-n}^{n} Y_n^{m*}(\Theta)Y_n^m(\Theta_s)C_n^m(\Theta_s). \tag{2}$$

For the placement of microphones at special quadrature points, a set of unity quadrature weights $C_n^m$ are achieved. In practice, it was observed that for $\{\Theta_s\}$ at the so-called Fliege points, higher order beampatterns were achieved with some noise (approaching that achievable by interpolation $(N+1)=\sqrt{S}$). In our beamformer, we use one order lower than this limit, and the Fliege microphone locations, though we also consider the case where weights are generated separately and stored in a table.

Figure 1:
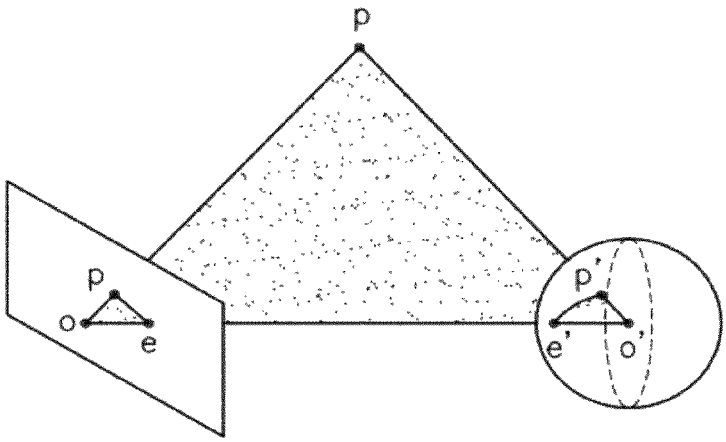
FIG. 1 depicts epipolar geometry between a video camera (left), and a spherical array sound camera. The world point P and its image point p on the left are connected via a line passing through PO. Thus, in the right image, the corresponding image point p lies on a curve which is the image of this line (and vice versa, for image points in the right video camera).
Figure 2:
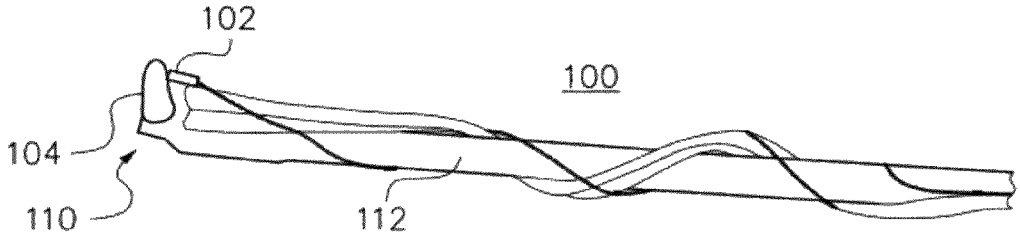
FIG. 2 shows a calibration wand consisting of a microspeaker and an LED, collocated at the end of a pencil, which was used to obtain the fundamental matrix.

Joint Audio-Video Processing and Calibration: In A. O'Donovan, R. Duraiswami, and J. Neumann, Microphone Arrays as Generalized Cameras for Integrated Audio Visual Processing, Proc. IEEE CVPR, 2007, there is provided a detailed outline of how to use cameras and spherical arrays together and determine the geometric locations of a source. The key observation was that the intensity image at different frequencies created via beamforming using a spherical array could be treated as a central projection (CP) camera, since the intensity at each "pixel" is associated with a ray (or its spherical harmonic reconstruction to a certain order). When two CP cameras observe a scene, they share an "epipolar geometry" (FIG. 1). Given two cameras and several correspondences (via a calibration object such as the calibration wand 100 shown in FIG. 2), a fundamental matrix that encodes the calibration parameters of the camera and the parameters of the relative transformation (rotation and translation) between the two camera frames can be computed. Given a fundamental matrix of a stereo rig, points can be taken in one camera's coordinate system and related directly to pixels in the second camera's coordinate system. Given more video cameras, a complete solution of the 3D scene structure common to the two cameras can be made, and "image transfer" that allows the transfer of the audio intensity information to actual scene objects made precisely. Given a single camera and a microphone array, the transfer can be accomplished if we assume that the world is planar (or that it is on the surface of a sphere) at a certain range.

General Purpose GPU Processing: Recently graphics processors (GPUs) have become an incredibly powerful computing workhorse for processing computationally intensive highly parallel tasks. Recently NVidia released the Compute Unified Device Architecture (CUDA) along with the G8800 GPU with a theoretical peak speed of 330 Gflops, which is over two orders of magnitude larger than that of a state of the art Intel processor. This release provides a C-like API for coding the individual processors on the GPU that makes general purpose GPU programming much more accessible. CUDA programming, however still requires much trial and error, and understanding of the nonuniform memory architecture to map a problem on to it. In the present disclosure we (referring to the Applicants) map the beamforming, image creation, image transfer, and beamformed signal computation problems to the GPU to achieve a frame-rate audio-video camera.

B. Exemplary System Setup

Figure 3:
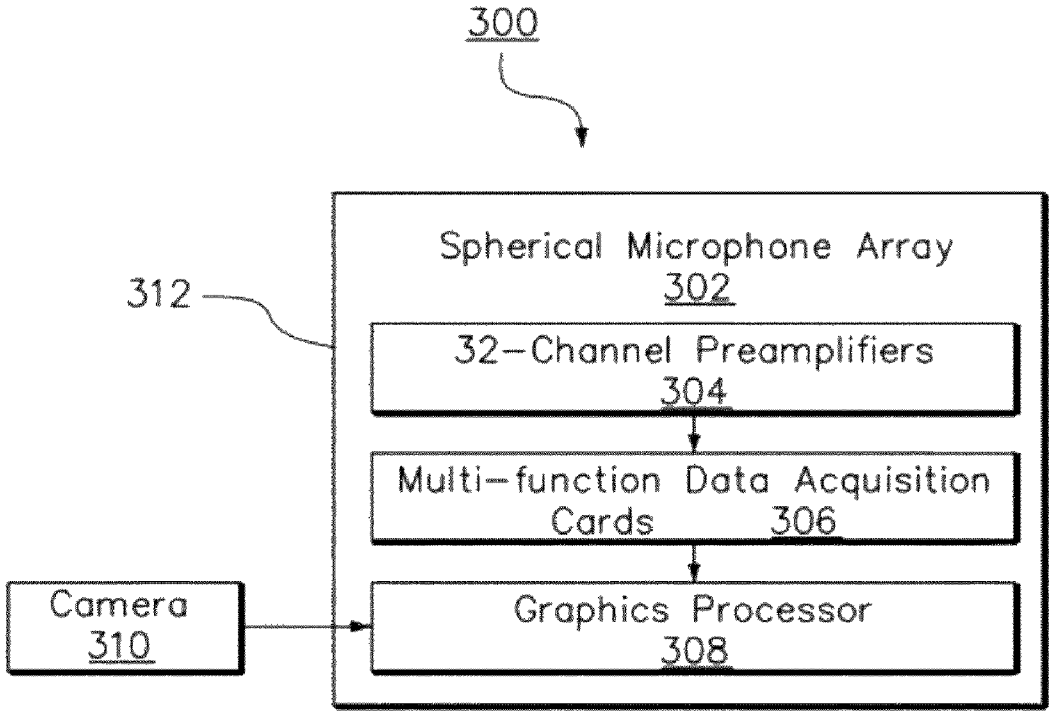
FIG. 3 shows a block diagram of a camera and spherical array system consisting of a camera and microphone spherical array in accordance with the present disclosure.

With reference to FIG. 3, audio information was acquired using a previously developed solid spherical microphone array 302 of radius 10 cm whose surface was embedded with 60 microphones. The signals from the microphones are amplified and filtered using two custom 32-channel preamplifiers 304 and fed to two National Instruments PCIe-6259 multi-function data acquisition cards 306. Each audio stream is sampled at a rate of 31250 samples per second. The acquired audio is then transmitted to an NVidia G8800 GTX GPU 308 installed in a computer running Windows® with an Intel Core2 processor and a clock speed of 2.4 GHz with 2 GB of RAM. The NVidia G8800 GTX GPU 308 utilizes a 16 SIMD multiprocessors with On-Chip Shared memory. Each of these multiprocessors is composed of eight separate processors that operate at 1.35 GHz for a total of 128 parallel processors. The G8800 GTX GPU 308 is also equipped with 768 MB of onboard memory. In addition to audio acquisition, video frames are also acquired from an orange micro IBot USB2.0 web camera 310 at a resolution of 640×480 pixels and a frame rate of 10 frames per second. The images are acquired using OpenCV and are immediately shipped to the onboard memory of the GPU 308. A block diagram of the system is shown by FIG. 3*a*.

The preamplifiers 304, data acquisition cards 306 and graphics processor 308 collectively form a processing unit 312. The processing unit 312 can include hardware, software, firmware and combinations thereof for performing the functions in accordance with the present disclosure.

C. Real-Time Processing

Since both pre-computed weights and analytically prescribed weights capable of being generated "on-the-fly" are used, we present the generation of images for both cases.

Pre-computed weights: This algorithm proceeds in a two stage fashion: a precomputation phase (run on the CPU) and a run-time GPU component. In stage 1 pixel locations are defined prior to run-time and the weights are computed using any optimization method as described in the literature. These weights are stored on disk and loaded at Runtime. In general the number of weights that must be computed for a given audio image is equal to P M F where P is the number of audio pixels, M is the number of microphones, and F is the number of frequencies to analyze. Each of these weights is a complex number of size 8 bytes.

After pre-computation and storage of the beamformer weights in the run-time component the weights are read from disk and shipped to the onboard memory of the GPU. A circular buffer of size 2048×64 is allocated in the CPU memory to temporarily store the incoming audio in a double buffering configuration. Every time 1024 samples are written to this buffer they are immediately shipped to a pre-allocated buffer on the GPU. While the GPU processes this frame the second half of the buffer is populated. This means that in order to process all of the data in real-time all of the processing must be completed in less then 33 ms, to not miss any data.

Once audio data is on the GPU we begin by performing an in place FFT using the cuFFT library in the NVidia CUDA SDK. A matrix vector product is then performed with each frequency's weight matrix and the corresponding row in the FFT data, using the NVidia CuBlas linear algebra library. The output image is segmented into 16 sub-images for each multiprocessor to handle. Each multiprocessor is responsible for compiling the beamformed response power in three frequency bands into the RGB channels of the final pixel buffer object. Once this is completed control is restored to the CPU and the final image is displayed to the screen as a texture mapped quad in OpenGL.

On the fly weight computation: In this implementation there is a much smaller memory footprint. Where as we needed space to be allocated for weights on the GPU in the previous algorithm this one only needs to store the location of the microphones. At start up these locations are read from disk and shipped to the GPU memory. Efficient processing is achieved by making use of the addition theorem which states that $$P_n(\cos\gamma) = \frac{4\pi}{2n+1}\sum_{m=-n}^{n} Y_n^{-m}(\Theta)Y_n^{m}(\Theta_s) \tag{3}$$

where $\Theta$ is the spherical coordinate of the audio pixel and $\Theta_s$ is the location of the s th microphone, $\gamma$ is the angle between these two locations and $P_n$ is the Legendre polynomial of order n. This observation reduces the order $n^2$ sum in Eq. (2) to an order n sum. The $P_n$ are defined by a simple recursive formula that is quickly computed on the GPU for each audio pixel.

The computation of the audio proceeds as follows. First we load the audio signal onto the GPU and perform an inplace FFT. We then segment the audio image into 16 tiles and assign each tile to a multiprocessor of the GPU. Each thread in the execution is responsible for computing the response power of a single pixel in the audio image. The only data that the kernel needs to access is the location of the microphone in order to compute $\gamma$ and the Fourier coefficients of the 60 microphone signals for all frequencies to be displayed. The weights can then be computed using simple recursive formula for each of the Hankel, Bessel, and Legendre polynomials in Eq. (2).

While performance of the beamformer may be a bit worse, there are several benefits to the on-the-fly approach: 1) frequencies of interest can be changed at runtime with no additional overhead; 2) pixel locations can be changed at runtime with little additional overhead; 3) memory requirements are drastically lower then storing pre-computed weights.

Beamforming: Once a source location of interest is identified, we can use the results of the beamforming to obtain the beamformed sound from that direction, by taking the beamforming results at frequencies of the microphone array effectiveness, and appending to that the frequencies from outside the band from the Fourier transform of the signal from the microphone closest to the direction.

D. Results

Figure 4A:
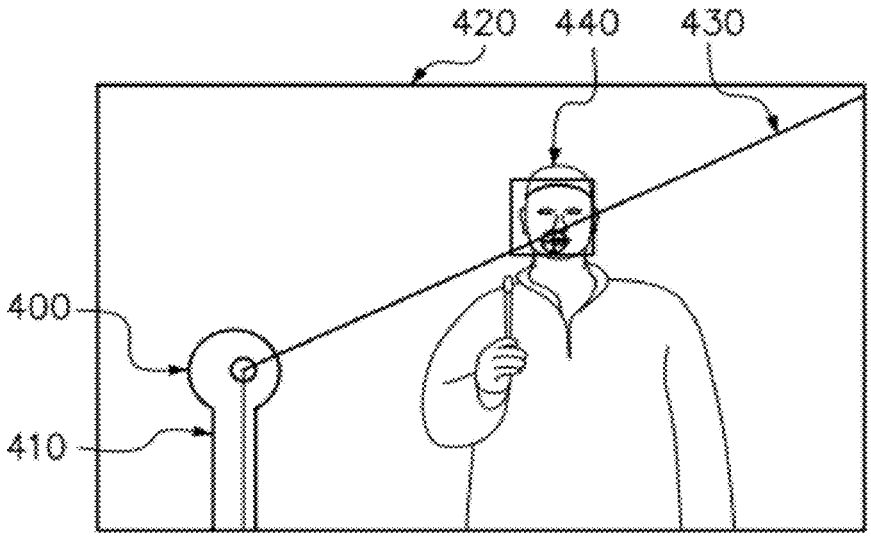
FIGS. 4*a* and 4*b*: A loud speaker source was played that overwhelmed the sound of the speaking person (FIG. 4*a*), whose face was detected with a face detector and the epipolar line corresponding to the mouth location in the vision image was drawn in the audio image (FIG. 4*b*). A search for a local audio intensity peak along this line in the audio image allowed precise steering of the beam, and made the speaker audible.
Figure 4B:
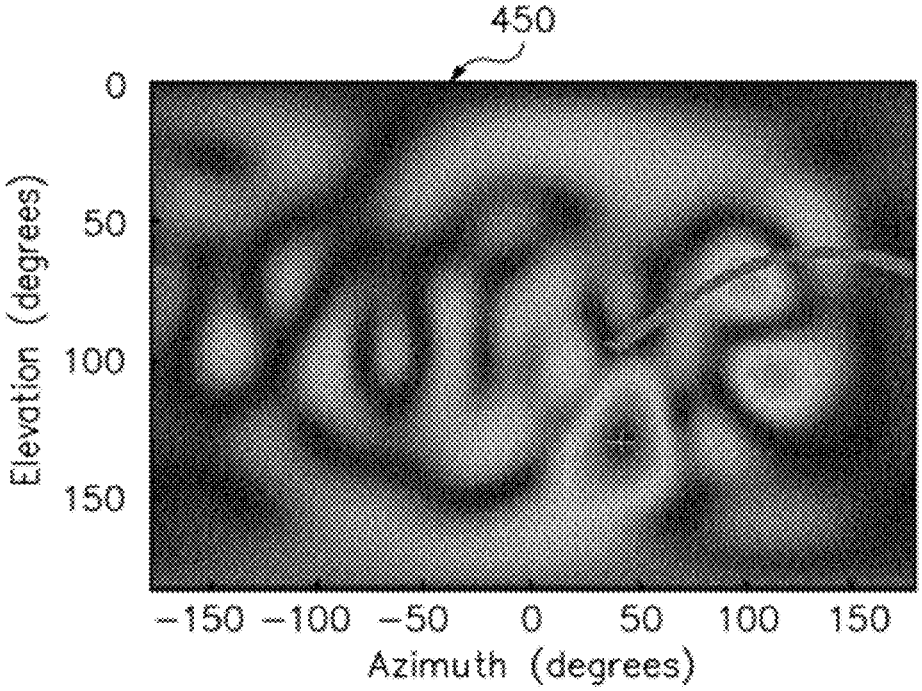

Vision guided beamforming: Several authors have in the past proposed vision guided beamforming. The idea is that vision based constraints can help us to not steer the beamformer in directions that are not promising. Often these constraints require the source to lie in some constrained region. One crucial difference here is that the quality of the geometric constraints provided by the epipolar geometry is much stronger. We illustrate in FIG. 4*a* this example with a case where a speaker's voice is beamformed in the presence of severe noise using location information from vision. Using a calibrated array-camera combination having a spherical microphone array 400 and a camera 410 and computing hardware (see FIG. 3), we applied a standard face detection algorithm to the vision image 420 and then used the epipolar line 430 induced by the mouth region 440 of the vision image 420 to search for the source in the audio image 450 (FIG. 4*b*).

Image transfer: Noise source identification via acoustic holography seeks to determine the noise location from remote measurements of the acoustic field. Here we add the capacity to visually identify the source via automatic warping of the sound image. This implementation also has application to areas such as gunshot detection, meeting recording (identifying who's talking), etc. We used the method of precomputed weights. An audio image was generated at a rate of 30 frames per second and video was acquired at a rate of 10 frames per second. In order to reduce the effects of incoherent reverberation and spurious peaks we incorporated a temporal filter of the audio image prior to transfer. Once the audio image is generated a second GPU kernel is assigned to generate the image transfer overlay which is then alpha blended with the video frame.

The audio video stereo rig was calibrated according to A. O'Donovan, R. Duraiswami, and J. Neumann, Microphone Arrays as Generalized Cameras for Integrated Audio Visual Processing, Proc. IEEE CVPR, 2007, the entire contents of which are incorporated herein by reference. The audio image transfer is also performed in parallel on the GPU and the corresponding values are then mapped to a texture and displayed over the video frame. To decrease pixilation artifacts the kernel also performs bilinear interpolation. Though the video frames are only acquired at 10 frames per second the over-laid audio image achieves the same frame rate as the audio camera (30 frames per second).

Figure 5A:
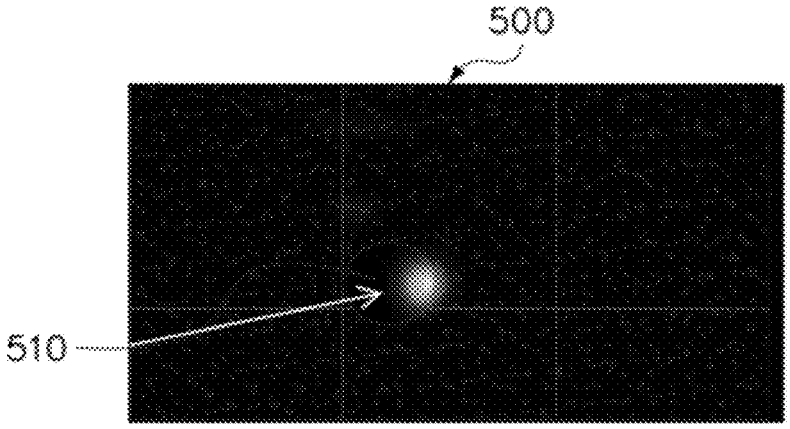
FIGS. 5*a* and 5*b* show an image transfer example of a person speaking. The spherical array image (FIG. 5*a*) shows a bright spot at the location corresponding to the mouth. This spot is automatically transferred to the video image (FIG. 5*b*) (where the spot is much bigger, since the pixel resolution of video is higher), identifying the noise location as the mouth.
Figure 5B:
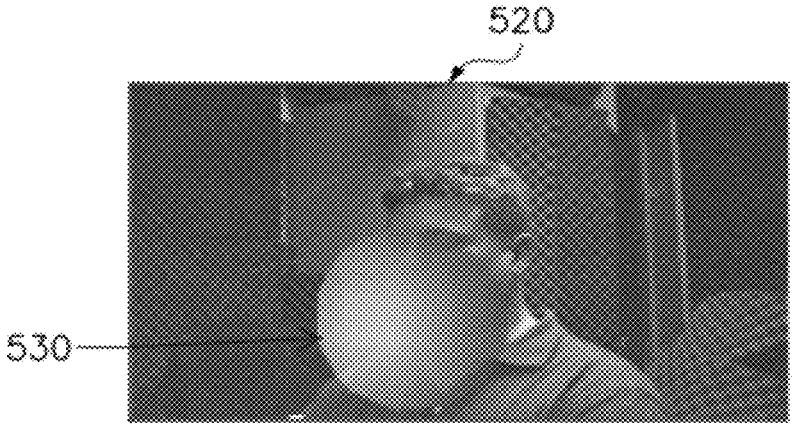

Image transfer example: A person speaks. The spherical array image 500 (FIG. 5*a*) shows a bright spot 510 at the location corresponding to the mouth. This spot 510 is automatically transferred to the video image 520 (FIG. 5*b*) (where the spot 530 is much bigger, since the pixel resolution of video is higher), identifying the noise location as the mouth.

II. Microphone Arrays as Generalized Cameras for Integrated Audio Visual Processing

A. MOTIVATION AND PRESENT CONTRIBUTION

In most previous work, the fusion of the audio-visual information occurs at a relatively late stage. In contrast, the present disclosure takes the viewpoint that both cameras and microphone arrays are geometry sensors, and treats the microphone arrays as generalized cameras. Computer-vision inspired algorithms are employed to treat the combined system of arrays and cameras. In particular, the present disclosure considers the geometry introduced by a general microphone array and spherical microphone arrays. The latter show a geometry that is very close to central projection cameras, and the present disclosure shows how standard vision based calibration algorithms can be profitably applied to them. Several experiments are presented herein that demonstrate the usefulness of the considered approach.

Arrays of microphones can be geometrically arranged and the sound captured can be used to extract information about the geometrical location of a source. Interest in this subject was raised by the idea of using a relatively new sensor and an associated beamforming algorithm for audiovisual meeting recordings (see FIGS. 4*a* and 4*b*). This array has since been the subject of some research in the audio community. While considering the use of the array to detect and to beamform (isolate) an auditory source in the meeting system, it was observed that this microphone array is a central projection device for far-field sound sources, and can be easily treated as a "camera" when used with more conventional video cameras. Moreover, certain calibration problems associated with the device can be solved using standard approaches in computer vision.

The present disclosure relates to spherical microphone arrays. However, we (referring to the applicants) were naturally led to how other microphone arrays could be included in the framework as generalized cameras, similar to the recent work in vision on generalized cameras, that are imaging devices that do not restrict themselves to the geometric or photometric constraints imposed by the pinhole camera model, including the calibration of such generalized bundles of rays. In the most general case, any camera is simply a directional sensor of varying accuracy.

Microphone arrays that are able to constrain the location of a source can be interpreted as directional sensors. Due to this conceptual similarity between cameras and microphone arrays, it is possible to utilize the vast body of knowledge about how to calibrate cameras (i.e. directional sensors) based on image correspondences (i.e. directional correspondences). Specifically, the fact that spherical arrays of microphones can be approximated as directional sensors which follow a central projection geometry is utilized. Nevertheless, the constraints imposed by the central projection geometry allow the application of proven algorithms developed in the computer vision community as described in the literature to calibrate arbitrary combinations of conventional cameras and spherical microphone arrays.

Below there is a brief review of some relevant work. Next, in section C, there is provided some background material on audio processing, to make the present disclosure self contained, and to establish notation. Section D describes the algorithms developed for working with the spherical array and cameras, and results are described. Section E has conclusions and discusses applications of the teachings according to the present disclosure to other types of microphone arrays.

B. PRIOR WORK

Microphone arrays have long been used in many fields (e.g., to detect underwater noise sources), to record music, and more recently for recording speech and other sound. The latter is of concern here, and there is a vast literature on the area. An introduction to the field may be obtained via a pair of books that are collections of invited papers that cover different aspects of the field (M. S. Brandstein and D. B. Ward (editors), Microphone Arrays Signal Processing Techniques and Applications, Springer-Verlag, Berlin, Germany, 2001; Y. A. Huang and J. Benesty, ed. Audio Signal Processing For Next Generation Multimedia Communication Systems, Kluwer Academic Publishers 2004). Solid spherical microphone arrays were first developed (both theoretically and experimentally) by Meyer and Elko (J. Meyer and G. Elko. "A highly scalable spherical microphone array based on anorthonormal decomposition of the soundfield," Proceedings IEEE ICASSP, 2:1781-1784, 2002; J. Meyer and G. Elko, "Spherical Microphone Arrays for 3D sound Recording," Audio Signal Processing For Next Generation Multimedia Communication Systems Ed. Y. A. Huang and J. Benesty, 67-89, Kluwer Academic Publishers 2004) and extended by Li et al. (Z. Li, R. Duraiswami, E. Grassi, and L. S. Davis, "Flexible layout and optimal cancellation of the orthonormality error for spherical microphone arrays," Proceedings IEEE ICASSP, 4:41-44, 2004; Z. Li and Ramani Duraiswami; "Hemispherical microphone arrays for sound capture and beamforming," Proceedings IEEE WASPAA, 106-109, 2005).

There are several papers that consider combined audio visual processing. Pointing a pan-tilt-zoom camera at a sound source has been achieved by several authors, while a few employ the knowledge of the location of the sound source obtained from vision to improve the audio processing. Several authors have performed joint audio-visual tracking using various approaches (particle filtering, learning a probabilistic graphical model using low level audio and visual features, finding the pixels that create sound via an efficient formulation of canonical correlation analysis, and built a large efficient industrial system). Modern image processing and computer vision techniques were used to define new features for sound recognition.

One paper describes the development of the joint geometry of an underwater sonar camera system (Shahriar Negahdaripour, "Epipolar Geometry of Opti-Acoustic Stereo Imaging," IEEE Transactions on Pattern Analysis and Machine Intelligence, 2007). There is a difference however in the methods used in that paper, which relies on active probing of the scene using acoustic pulses, and then images it rather like LADAR, using a time of flight map for the reflected signals. Due to the large error in the 3rd coordinate of their estimates the authors chose to treat the sensor as a 2D sensor, with the two retained image dimensions as range and one angular coordinate. In contrast, the present disclosure discusses microphone arrays whose "image" geometry is similar to that in regular central projection cameras, and do not actively probe the scene but rely on sounds created in the environment. The sensor described herein would be useful in indoor people and industrial noise monitoring situations, while the sensor described by Shahriar Negahdaripour would be useful in underwater imaging.

C. BACKGROUND

C.1. Source Localization and Beamforming

Assume that the acoustic source that produces an acoustic signal y(t) is located at point p and K microphones are located at points $q_1, \ldots, q_k$. The signal $s_m(t)$ received at the $m^{th}$ microphone contains delayed versions of the source signal, its convolution with the channel impulse response, and noise (or other sources) and is given by $$s_m(t)=r_m^{-1}y(t-\tau_m)+y(t)\mathring{a}h^*_m(q_m,p,t)+z_m(t). \quad (4)$$

where the first term on the right is the direct arriving signal, $r_m=\|p-q_m\|$ is the distance from the source to the $m^{th}$ microphone, c is the sound speed, $\tau_m=r_m/c$ is the delay in the signal reaching the microphone, $h^*_m(q_m,p,t)$ is the filter that models the reverberant reflections (called the room impulse response, RIR) for the given locations of the source and the $m^{th}$ microphone, star denotes convolution, and $z_m(t)$ is the combination of the channel noise, environmental noise, or other sources; it is assumed to be independent at all microphones and uncorrelated with y(t).

In general $\tau_m$ will not be measurable as the source position is unknown. Knowing the locations of two microphones, m and n respectively, We denote the time difference of arrival (TDOA) of a signal between receivers m and n as $\tau_{mn}=\tau_n-\tau_m$. TDOAs are usually obtained using a generalized cross-correlation (GCC) between signal frames (short pieces of the signal of length N) $s_m$ and $s_n$ acquired at the $m^{th}$ and $n^{th}$ sensors respectively [10]. Let us denote by $r_{mn}(\tau)$ the GCC of $s_n(t)$ and $s_m(t)$ and its Fourier transform by $R_{mn}(\omega)$). Then, $$R_{mn}(\omega)=W_{mn}(\omega)S_m(\omega)S^*_n(\omega), \quad (5)$$

where $W_{mn}(\omega)$ is a weighting function. Ideally, $r_{mn}(\tau)$ (computed as the inverse Fourier transform of $R_{mn}(\omega)$) will have a peak at the true TDOA between sensors m and n ($\tau_{mn}$). In practice, many factors such as noise, finite sampling rate, interfering sources and reverberation might affect the position and the magnitude of the peaks of the cross correlation, and the choice of the weighting function can improve the robustness of the estimator. The phase transform (PHAT) weighting function was introduced in C. H. Knapp and G. C. Carter, "The generalized correlation method for estimation of time delay", IEEE Transactions on Acoustics, Speech and Signal Processing, 24:320-327, 1976:

$$W_{mn}(\omega)=|S_m(\omega)S^*_n(\omega)|^{-1}. \quad (6)$$

The PHAT weighting places equal importance on each frequency by dividing the spectrum by its magnitude. It was later shown that it is more robust and reliable in realistic reverberant acoustic conditions than other weighting functions designed to be statistically optimal under specific non-reverberant noise conditions.

Source localization using time delays: The availability of a single time delay between a pair of receivers, places the source on a hyperboloid of revolution of two sheets, with its foci at the two microphones (see FIG. 7). In human hearing, time delays between the two ears places the source on this hyperboloid (also mislabeled the "cone of confusion"), and humans have to use other cues to resolve ambiguities. In general purpose arrays, additional microphones can be added, and intersect the hyperboloids formed by delay measurements with each pair. Measurements at three collinear microphones restrict the source to lie on a circle whose center lies on the axis formed by the microphones, while knowing the time delays between 4 non-collinear microphones in principle can provide the exact source location. However, TDOAs are very noisy, and the non-linear intersection algorithms may give poor results with the noisy input data, and various methods to improve the algorithms are still being developed by researchers.

Beamforming: The goal of beamforming is to "steer" a "beam" towards the source of interest and to pick its contents up in preference to any other competing sources or noise. The simplest "delay and sum" beamformer takes a set of TDOAs (which determine where the beamformer is steered) and computes the output SB(t) as $$s_B(t) = \frac{1}{K}\sum_{m=1}^{K} s_m(t+\tau_{ml}), \quad (7)$$

where l is a reference microphone which can be chosen to be the closest microphone to the sound source so that all $\tau_{ml}$ are negative and the beamformer is causal. To steer the beamformer, one selects TDOAs corresponding to a known source location. Noise from other directions will add incoherently, and decrease by a factor of $K^{-1}$ relative to the source signal which adds up coherently, and the beamformed signal is clear. More general beamformers use all the information in the K microphone signal at a frame of length N, may work with a Fourier representation, and may explicitly null out signals from particular locations (usually directions) while enhancing signals from other locations (directions). The weights are then usually computed in a constrained optimization framework.

Beampattern: The pattern formed when the, usually frequency-dependent, weights of a beamformer are plotted as an intensity map versus location are called the beampattern of the beamformer. Since usually beamformers are built for different directions (as opposed to location), for source that are in the "far-field," the beampattern is a function of two angular variables. Allowing the beampattern to vary with frequency gives greater flexibility, at an increased optimization cost and an increased complexity of implementation.

Localization via Steered Beamforming: One way to perform source localization is to avoid nonlinear inversion, and scan space using a beamformer. For example, if using the delay and sum beamformer the set of time delays $\hat{\tau}_{mn}$ corresponds to different points in the world being checked for the position of a desired acoustic source, and a map of the beamformer power versus position may be plotted. Peaks of this function will indicate the location of the sound source. There are various algorithms to speed up the search.

C.2. Spherical Microphone Arrays

The present disclosure is concerned with solid spherical microphone arrays (as in FIGS. 3 and 4) on whose surface several microphones are embedded. In J. Meyer and G. Elko, "A highly scalable spherical microphone array based on anorthonormal decomposition of the soundfield," Proceedings IEEE ICASSP, 2:1781-1784, 2002, an elegant prescription that provided beamformer weights that would achieve as a beampattern any spherical harmonic function $Y_n^m(\theta_k,\phi_k)$ of a particular order n and degree m in a direction $(\theta_k, \phi_k)$ was presented. Here $$Y_n^m(\theta, \varphi) = (-1)^m \sqrt{\frac{2n+1}{4\pi}\frac{(n-|m|)!}{(n+|m|)!}}\, P_n^{|m|}(\cos\theta)e^{im\varphi}, \tag{8}$$

where n=0, 1, 2, . . . and m=−n, . . . , n, and $P_n^{|m|}$ is the associate Legendre function. The maximum order that was achievable by a given array was governed by the number of microphones, S, on the surface of the array, and the availability of spherical quadrature formulae for the points corresponding to the microphone coordinates $(\theta_i,\phi_i)$, i=1, . . . , S. In Li, R. Duraiswami, E. Grassi, and L. S. Davis, "Flexible layout and optimal cancellation of the orthonormaility error for spherical microphone arrays," Proceedings IEEE ICASSP, 4:41-44, 2004, the analysis is extended to arbitrarily placed microphones on the sphere.

Since the spherical harmonics form a basis on the surface of the sphere, building the spherical harmonic expansion of a desired beampattern, allowed easy computation of the weights necessary to achieve it. In particular if one desires a beampattern that is a delta function, truncated to the maximum achievable spherical harmonic order p, in a particular direction $(\theta_0,\phi_0)$, then the following algorithm can be used $$\delta^{(p)}(\theta-\theta_0, \varphi-\varphi_0) = 2\pi\sum_{n=0}^{p-1}\sum_{m=-n}^{n} Y_n^{m*}(\theta_0, \varphi_0)Y_n^m(\theta, \varphi), \tag{9}$$

to compute the weights for any desired look direction. This beampattern is often called the "ideal beampattern," since it enables picking out a particular source. The beampattern achieved at order 6 is shown in FIG. 3. A spherical array can be used to localize sound sources by steering it in several directions and looking at peaks in the resulting intensity image formed by the array response in different directions.

The ability of an array to isolate a sound source from a given look direction is often quantified by the directivity index and is given in dB:

$$DI(\theta_0, \theta_s, ka) = 10\log_{10}\left(\frac{4\pi|H(\theta_0, \theta_0)|^2}{\int_{\Omega_s}|H(\theta, \theta_0)|^2\, d\Omega_s}\right), \tag{10}$$

where $H(\theta,\theta_0)$ is the actual beampattern looking at $\theta_0=(\theta_0,\phi_0)$ and $H(\theta_0,\phi_0)$ is the value in that direction. The DI is the ratio of the gain for the look direction $\theta_0$ to the average gain over all directions. If a spherical microphone array can precisely achieve the regular beampattern of order N as described in Z. Li and Ramani Duraiswami, "Flexible and Optimal Design of Spherical Microphone Arrays for Beamforming," IEEE Transactions on Audio, Speech and Language Processing, 15:702-714, 2007, its theoretical DI is 20 $\log_{10}(N+1)$. In practice, the DI index will be slightly lower than the theoretical optimal due to errors in microphone location and signal noise.

Spherical microphone arrays can be considered as central projection cameras. Using the ideal beam pattern of a particular order, and beamforming towards a fixed grid of directions, one can build an intensity map of a sound field in particular directions. Peaks will be observed in those directions where sound sources are present (or the sound field has a peak due to reflection and constructive interference). Since the weights can be pre-computed and a relatively short fixed filters, the process of sound field imaging can proceed quite quickly. When sounds are created by objects that are also visualized using a central projection camera, or are recorded via a second spherical microphone array, an epipolar geometry holds between the camera and the array, or the two arrays. Below experiments which were conducted by us (referring to the applicants) are described which confirm this hypothesis.

D. EXPERIMENTS WITH SPHERICAL ARRAYS AND CAMERAS

A 60-microphone spherical microphone array of radius 10 cm was constructed. A 64 channel signal acquisition interface was built using PCI-bus data acquisition cards that are mounted in the analysis computer and connected to the array, and the associated signal processing apparatus. This array can capture sound to disk and to memory via a Matlab data acquisition interface that can acquire each channel at 40 kHz, so that a Nyquist frequency of 20 kHz is achieved. The same Matlab was equipped with an image-processing toolbox, and camera images were acquired via a USB 2.0 interface on the computer. A 320×240 pixel, 30 frames per second web camera was used. While, the algorithms should be capable of real-time operation, if they were to be programmed in a compiled language and linked via the Matlab mex interface, in the present work this was not done, and previously captured audio and video data were processed subsequently.

Camera and Array Calibration: The camera was calibrated using standard camera calibration algorithms in OpenCV, while the array microphone intensities were calibrated as described in the spherical array literature. We then proceeded with the task of relative calibration of the array 302 (FIG. 3) and the camera 310. To calibrate this system 300, we built a wand 100 that has an LED 102 and a small speaker 104 (both about 3 mm×3 mm) collocated at the tip or end 110 of a pencil 112 (see FIG. 2). When a button is pressed, the LED 102 lights up and a sound chirp is simultaneously emitted from the speaker 104. Light and sound are then simultaneously recorded by the camera and microphone array respectively. We can determine the direction of the sound by forming a beam pattern as described above which turns the microphone array into a directional sensor.

Figure 6:
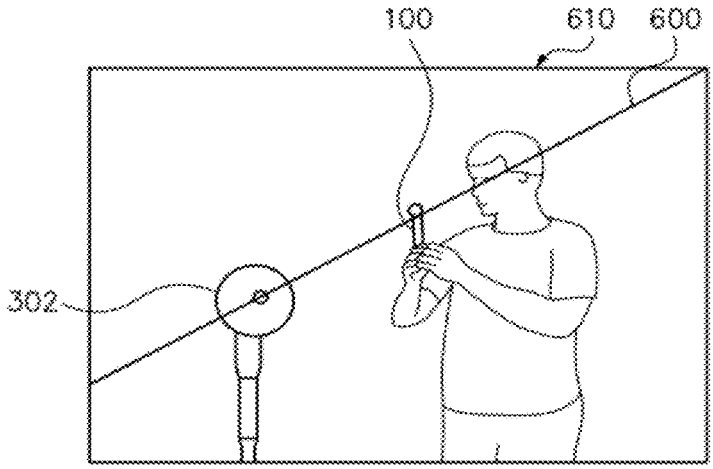
FIG. 6 shows a camera image of a calibration procedure.

In FIG. 6 there is shown an example sample acquisition. Notice the epipolar line 600 passing through the microphone array 302 having a plurality of microphones as the user holds the calibration wand 100 in the camera image 610.

As one can see the calibration recovered the epipolar geometry between the camera 310 and the array 302 very accurately. The same procedure can also be used to calibrate several (hemi-)spherical microphone arrays since both are equivalent to internally calibrated cameras, and thus also have to conform to the epipolar geometry. FIG. 1 shows how the image ray projects into the spherical array and intersects the peak of the beam pattern.

D.1. One Camera and One Spherical Array

In this case, the camera image and "sound image" are related by the epipolar geometry induced by the orientation and location of the camera and the microphone array respectively. We will assume that the camera is located at the origin of the fiducial coordinate system. For each sound we thus have the direction $r_{mic}$, which we need to correspond to the projection of the 3D location of the sound source into the camera image $p_{cam}$.

If we have precalibrated the camera, then we can transform $p_{cam}$ into normalized image coordinates $r_{cam}=K^{-1}p_{cam}$ where K is the internal calibration matrix of the camera (we disregard the radial distortion parameters). If the camera coordinate system and the microphone coordinate system are related by a rotation matrix R and a translation vector T, then each correspondence is related by the essential matrix E:

$$0=r_{mic}^{t}Er_{cam}=r_{mic}^{r}[T]_{x},\ Rr_{cam} \tag{10}$$

To compute the essential matrix E and extract T and R, we follow Y. Ma, J. Kosecka, and S. S. Sastry, "Motion recovery from image sequences: Discrete viewpoint vs. differential viewpoint," Proceedings ECCV, 2:337-353, 1998. We decide among the resulting four solutions by choosing the solution that maximizes the number of positive depths for the microphone array and the camera.

If the camera is not calibrated, then the direction in the microphone and the pixel in the image would be related by the fundamental matrix F:

$$0==r_{mic}^{t}Fp_{cam}=r_{mic}^{t}[T]_{x}RK^{-1}p_{cam} \tag{11}$$

We can solve for F using a multitude of algorithms as described in R. Hartley and A. Zisserman, Multiple View Geometry in Computer Vision. Cambridge University Press, Cambridge, UK, 2000, we chose to use a linear algorithm for which we need at least 8 correspondences, followed by nonlinear minimization that takes into account the different noise characteristics of the image and microphone array "image" formation process.

The epipolar geometry induces by the essential or fundamental matrices, allows us interchangeably to transfer a point from an image to a 1-D space in the microphone array directional space defined by $r_{mic}(Fp_{cam})=0$, or a directional measurement from the microphone array to an epipolar line defined by the equation $p_{cam}(F^{t}r_{mic})=0$.

D.2. N Cameras and One Spherical Array

Multicamera systems with overlapping fields of view, attached to microphone arrays are now becoming popular to record meetings. The location of speakers in an integrated mosaic image is a problem of interest in such systems. For multiple cameras, we only need to know the calibration information from two cameras, to use a method similar to the one described in J. P. Barreto and K. Daniilidis, "Wide area multiple camera calibration and estimation of radial distortion," OMNIVIS 2004—Workshop on Omnidirectional Vision and Camera Networks, Prague, Czech Republic, 2004 to calibrate the remaining cameras. Since the microphone is already intrinsically calibrated, we only need to determine the internal calibration parameters for a single camera, compute the calibration between the spherical array and the calibrated camera, reconstruct the correspondences in space, and then use the 3D points to calibrate the system of cameras as described by Barreto et al. The results could then be further improved using bundle-adjustment as described in B. Triggs, P. F. McLauchlan, R. I. Hartley, and A. W. Fitzgibbon, "Bundle adjustment—a modern synthesis," B. Triggs, A. Zisserman, and R. Szeliski, editors, Vision Algorithms: Theory and Practice, LNCS:1883. Springer-Verlag, 298-373, 1999.

Similarly, one could also use two (hemi-)-spherical microphone arrays, and an arbitrary number of uncalibrated cameras. First, we can calibrate the two microphone arrays using the epipolar constraint as described earlier. Then we can reconstruct the calibration points in space using the computed calibration. Due to the omnidirectional nature of the microphone array, we can be sure that all the calibration points are "visible" to both microphone arrays and thus can be reconstructed. We can now use the reconstructed structure to compute the projection matrices for each of the cameras. We can now use all the cameras and the microphone arrays together with the reconstructed points to initialize a bundle-adjustment procedure.

D.3. Example Application: Speaker Tracking and Noise Suppression

Using the epipolar geometry between a spherical microphone array and a camera in a meeting room scenario. The microphone array was used to detect the direction of sound sources in the scene, in this case the speaker in the room, and then the epipolar geometry, to project the epipolar line into the camera image. We can now employ a simple face detector along the vicinity of the epipolar line to located the exact position of the speaker in the image. In our system we use a face detector based on Haar wavelets as implemented in OpenCV (see R. Lienhart, L. Liang, and A. Kuranov, "A detector tree of boosted classifiers for real-time object detection and tracking," Proceedings IEEE ICME, 2:277-280, 2003). This allows us then to accurately zoom into the image and display a detailed view of the speaker. Since the search space is greatly reduced, the localization can be done extremely fast, and also switching from one speaker to the next can be done instantly.

In FIG. 4*b* there is shown the sound image where the peak indicates the mouth region, this peak is located and using the epipolar geometry projected into the image resulting in a epipolar line. We now search along this line for the most likely face position, triangulate the position in space and then set our zoom level accordingly.

The knowledge of the face location can help improve the recorded audio as well. We will now present an example in which an extremely loud music interference was played from a location to the left of the subject, and below him, after the face was initially detected as above. Once the face rectangle was extracted, a template match was used to detect the mouth region. The epipolar line from the image passing through this region was then constructed on the soundfield image. The lower panel of FIG. 4 shows the sound field image generated, where the distracter can be seen to be extremely bright compared to the source. The location corresponding to the mouth was passed to the beamforming algorithms, and the sound from this location was extracted. A further refinement of the algorithm could be to throw an explicit null at the location of the other source.

E. CONCLUSIONS AND OTHER CONSIDERATIONS

In accordance with the present disclosure, there is presented a novel approach that considers the geometrical restrictions introduced by microphone array measurements, and those introduced by cameras in a joint framework, which allows localization and calibration problems to be more efficiently solved. The theoretical sections above consider the general situation, and then the case of the spherical array is described in detail. The ideas were validated experimentally.

We believe that the approach considered here, of imaging the sound field using a spherical array(s) and the actual scene using camera(s) will have many applications, and several vision algorithms can be brought to bear. For example, when multiple cameras will be used with multiple spherical arrays, we can build a joint mosaic of the image and the soundfield image. Such an analysis can easily indicate locations where sounds are being created, their intensity and frequencies. This may have applications in industrial monitoring and surveillance.

Figure 7:
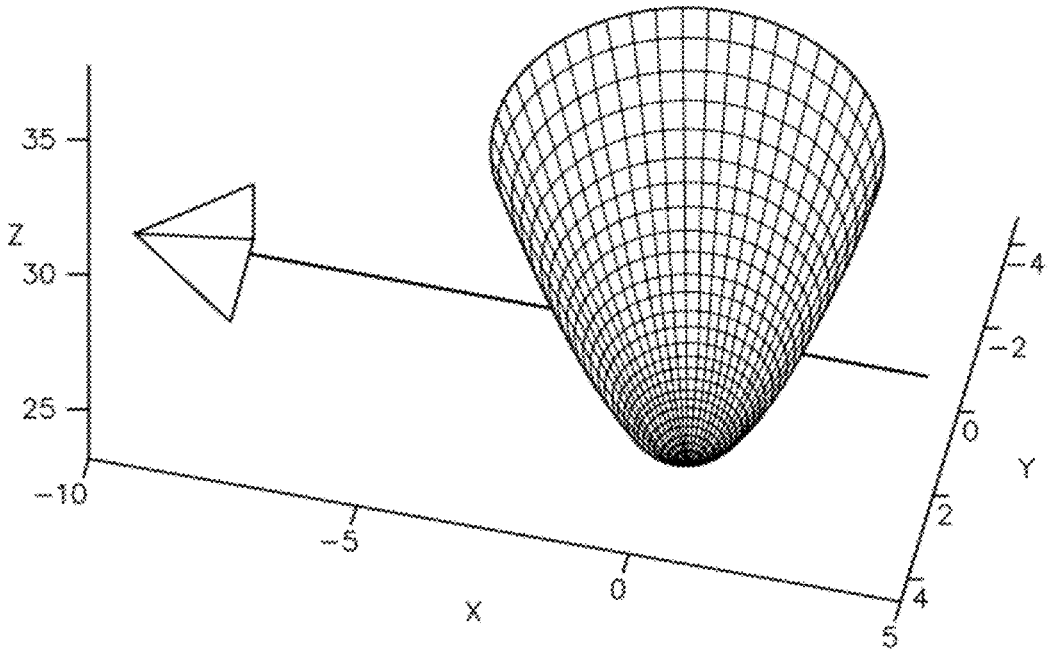
FIG. 7 graphically illustrates a ray from a camera to a possible sound generating object, and its intersection with the hyperboloid of revolution induced by a time delay of arrival between a pair of microphones. The source lies at either of the two intersections of the hyperboloid and the ray.

The audio camera in accordance with the present disclosure and its accompanying software and processing circuitry can be incorporated or provided to computing devices having regular microphone arrays. The computing devices include handheld devices (mobile phones and personal digital assistants (PDAs)), and personal computers. The microphone arrays provided to these computing devices often include cameras in them or cameras connected to them as well. In such computing devices, these microphones are used to perform echo and noise cancellation. Other locations where such arrays may be found include at the corners of screens, and in the base of video-conferencing systems. Using time delays, one can restrict the audio source to lie on a hyperboloid of revolution, or when several microphones are present, at their intersection. If the processing of the camera image is performed in a joint framework, then the location of the audio source can be quickly performed in accordance with the present disclosure, as is indicated in FIG. 7.

It would also be useful to consider some specialized systems where the camera and microphones are placed in a particular geometry. For example, the human head can be considered to contain two cameras with two microphones on a rigid sphere. A joint analysis of the ability of this system to localize sound creating objects located at different points in space using both audio and visual processing means could be of broad interest.

The contents of all references cited above are incorporated herein by reference in their entirety.

The described embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

What is claimed is:

1. A device comprising:

an array of microphones configured to generate audio data, the array of microphones being calibrated using an geometric constraint;

at least one video camera configured to generate video data; and a processing unit configured to:

receive the audio data generated by the array of microphones, receive the video data generated by the video camera, generate an audio image by processing the audio data, generate a video image by processing the video data, and transfer at least a portion of the audio image to the video image based at least in part on a shared geometry between the array of microphones and the at least one video camera.

2. The device according to claim 1, wherein the processing unit comprises at least one parallel processor.

3. The device of claim 2, wherein the parallel processor is a graphics processor.

4. The device according to claim 2, wherein the processing unit further comprises at least one multi-channel preamplifier for receiving, amplifying and filtering the audio data to generate at least one audio stream.

5. The device according to claim 4, wherein the processing unit further comprises at least one digitization device for sampling each of the at least one audio stream and outputting data to said at least one parallel processor.

6. The device according to claim 1, wherein the array of microphones is a spherical array.

7. The device according to claim 1, wherein the processing unit is configured to perform joint processing of the audio image and video image.

8. The device according to claim 7, wherein the processing unit is further configured to account for spatial differences in a location of the array of microphones and a location of the at least one video camera.

9. The device according to claim 7, wherein the joint processing is performed at frame rate.

10. The device of claim 1, wherein the audio image is an acoustical intensity image.

11. The device of claim 1, wherein the processing unit is configured to generate the audio image by beamforming the audio data.

12. The device of claim 11, wherein the processing unit is configured to beamform the audio data based at least in part on a beamformer weight computed for each of a plurality of audio pixels.

13. The device of claim 12, wherein the beamformed weights are computed based at least in part on a location of each of a plurality of microphones in the array of microphones.

14. The device of claim 1, wherein the geometric constraint is an epipolar constraint and the shared geometry between the array of microphones and the at least one video camera is an epipolar geometry.

15. The device of claim 1, wherein the at least one video camera comprises a plurality of video cameras.

16. The device of claim 1, wherein the device is a part of at least one system selected from the group consisting of a teleconference system, and a system for visual identification of noise sources.

17. A method comprising:

generating audio data using an array of microphones calibrated using a geometric constraint;

generating video data using at least one video camera;

receiving, using a processing unit, the audio data generated by the array of microphones;

receiving, using the processing unit, the video data generated by the video camera;

generating, using the processing unit, an audio image by processing the audio data;

generating, using the processing unit, a video image by processing the video data; and transferring, using the processing unit, at least a portion of the audio image to the video image based at least in part on a shared geometry between the array of microphones and the at least one video camera.

18. The method according to claim 17, further comprising relating points in the coordinate system of the array of microphones directly to pixels in the coordinate system of the at least one video camera.

19. The method according to claim 17, further comprising accounting for spatial differences in a location of the array of microphones and a location of the at least one video camera.

20. The method according to claim 17, further comprising amplifying and filtering the audio data to generate at least one audio stream.

21. The method according to claim 20, further comprising sampling the at least one audio stream and outputting data to at least one parallel processor.

22. The method according to claim 17, wherein the array of microphones is a spherical array.

23. The method according to claim 17, wherein the transferring step occurs at frame rate.

24. The method of claim 17, wherein the audio image is an acoustical intensity image.

25. The device of claim 17, wherein the generation of the audio image is performed by beamforming the audio data.

26. The device of claim 17, wherein the geometric constraint is an epipolar constraint and the shared geometry between the array of microphones and the at least one video camera is an epipolar geometry.

27. A device comprising:

means for generating audio data, the means of generating audio data being calibrated using a geometric constraint;

means for generating video data; and means for:

receiving the audio data generated by the array of microphones, receiving the video data generated by the video camera, generating an audio image by processing the audio data, generating a video image by processing the video data, and transferring at least a portion of the audio image to the video image based at least in part on a shared geometry between the array of microphones and the at least one video camera.

28. The device according to claim 27, further comprising a display for displaying an image comprising the portion of the audio image and at least a portion of the video image.

29. The device according to claim 27, further comprising means for identifying a location of an audio source, and means for indicating the location of the audio source.

30. The device according to claim 27, further comprising means for relating points in a coordinate system of the array of microphones directly to pixels in a coordinate system of the at least one video camera.

31. The device according to claim 27, further comprising means for accounting for spatial differences in a location of the array of microphones and a location of the at least one video camera.

32. The device according to claim 27, further comprising means for amplifying and filtering the audio data to generate at least one audio stream.

33. The device according to claim 32, further comprising means for sampling each of the at least one audio stream and outputting data to at least one parallel processor.

34. The device according to claim 27, wherein the means for transferring transfers at least the portion of the audio image to the video image at frame rate.

* * * * *